United States Patent [19]

Kuhn

[11] Patent Number: 4,928,327

[45] Date of Patent: May 29, 1990

[54] DEVICE FOR REDUCING RINSING WATER CONSUMPTION

[76] Inventor: Dieter Kuhn, Krauskopfalle 39, 6229 Georgenborn, Fed. Rep. of Germany

[21] Appl. No.: 195,241

[22] Filed: May 11, 1988

[30] Foreign Application Priority Data

May 18, 1987 [DE] Fed. Rep. of Germany ..... 3716624

[51] Int. Cl.[5] ..... E03D 1/35

[52] U.S. Cl. ..... 4/395; 4/324; 4/415

[58] Field of Search ..... 4/324, 325, 395, 415

[56] References Cited

U.S. PATENT DOCUMENTS

| | | | |
|---|---|---|---|
| 2,168,742 | 8/1939 | O'Neill et al. | 4/401 |
| 3,036,313 | 5/1962 | Jenkins | 4/324 |
| 3,345,648 | 10/1967 | Rafferty | 4/324 |
| 3,561,016 | 2/1971 | Reynolds | 4/324 X |
| 3,982,283 | 9/1976 | Goldring | 4/324 X |
| 4,091,474 | 5/1978 | Makhobey | 4/324 X |
| 4,467,482 | 8/1984 | Dyer | 4/395 |

*Primary Examiner*—Charles E. Phillips
*Attorney, Agent, or Firm*—Michael J. Striker

[57] ABSTRACT

A device for the reduction of water use in a WC water tank comprises a closing element which opens and closes an outlet opening of the tank and is formed as a buoyant member. The device ensures a various rationing of water discharged from the tank by a ring-shaped suppressing element provided on the closing element which hangs on a chain connected to an operating knob. The suppressing element exerts on the closing element a force which is greater than the force required to maintain the closing element buoyant.

8 Claims, 4 Drawing Sheets

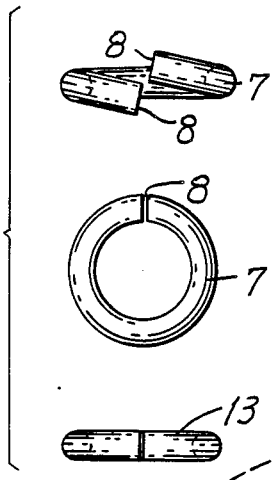
FIG.3
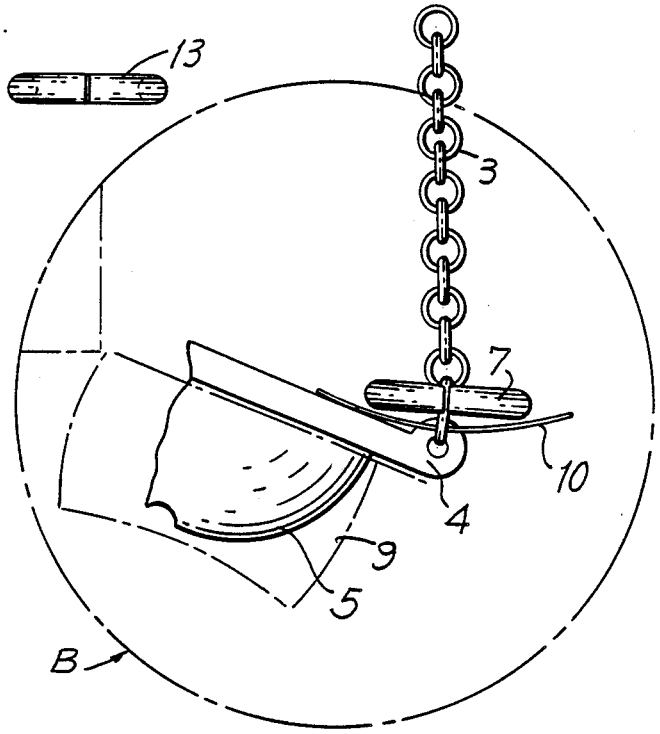
FIG.3a
FIG.4A
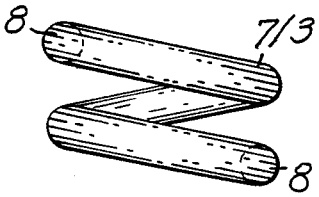
FIG.4B
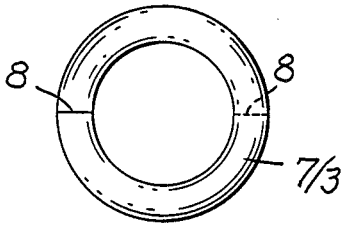

DEVICE FOR REDUCING RINSING WATER CONSUMPTION

BACKGROUND OF THE INVENTION

The present invention relates to a WC water tank, and more particularly to a device for the reduction of rinsing water consumption in WC water tanks which include a closing member formed as a buoyant element.

It has been required during the rinsing of the WC-tank that determined smallest amounts of water be released to prevent formation of crust and plugs in the open sewer system. Up to now about 10 liters of water has been considered as the smallest amount which should automatically flow from the tank upon the release of the latter. However, in order to reliably prevent contamination of the sewer system urine rinsing has been also unconditionally required.

For obtaining such discharge water amounts in conventional WC tanks a closing or locking element has been utilized, which closing element has a sealing which closes an outlet opening of the tank by continual hydrostatic pressure acting on the closing element. If the closing element is lifted upon the actuation of the rinsing knob the hydrostatic pressure is ceased and the closing element is lifted to permit the water drainage. Thereby the outlet opening remains open until the water tank is emptied. Then the closing element, normally an elastic ball, falls onto the outlet opening again and closes the latter so that water which fills the tank builds up hydrostatic pressure again until the next rinsing.

Due to the fact that drinking water reserves are to be conserved it has been necessary to reduce water consumption wherever necessary.

SUMMARY OF THE INVENTION

It is an object of the present invention to provide an improved device for the reduction of rinsing water consumption in WC-water tanks.

It is another object of the invention to provide a rinsing water reducing device in commercially available WC water tanks.

These and other objects of the invention are attained by a device for the reduction of the amount of rinsing water in a WC-water tank including a housing to be filled with water and having an outlet opening, a rinsing knob supported on said housing, and a closing element operatively connected to said knob for closing and opening said outlet opening, said closing element being formed as a buoyant element, said reduction device comprising a ring-shaped suppressing member provided on said closing element, and pulling means connecting said closing element to said knob, said pulling means being pivotable relative to said closing element, said suppressing member encircling said pulling means and exerting on said closing element a force which is greater than a force required to maintain said closing element in a buoyant state, said ring-shaped suppressing element including at least one ring.

Said one ring may be formed with an interrupting gap.

The ring-shaped suppressing element may be provided with a friction disc.

Said friction disc and said suppressing element may be formed as one unit.

The friction disc may be a ring with an interrupting gap.

The suppressing element may be made of plastic or elastic material with high specific weight.

The suppressing element may be formed of two half-rings pivotally connected to each other.

Said one ring may be helical in shape.

The two half-rings may each have a projection outwardly extending from a respective half ring, said suppressing element further including a spring retaining element connecting two projections of the two half-rings to each other.

The suppressing element may include two half-rings each formed with a circumferential groove, and a spring ring inserted into the grooves of said two half-rings to connect said half-rings to each other.

The advantage of the device according to the invention resides in that the closing element releases the outlet opening as long as the operating knob of the WC water tank is operated. Thereby the water drain can be interrupted by a user so as to ensure an optimal water use.

The formation of the suppressing or neutralizing element by a ring, particularly a ring having a gap resides in that it can be installed or interchanged by a consumer in commercially available WC water tanks.

The provision of the friction disc on the ringshaped suppressing element makes it possible to increase time of releasing of the closing element at the outlet opening by slowing descent of the closing element to a position in which the closing element closes the outlet opening, and thus automatically increase the amount of water flowing through the outlet opening. The greater is the diameter of the friction disc and the lesser deformable it is the longer is the time of releasing and vice versa.

The friction disc can be lifted together with the suppressing element and the closing element hanging on the pulling means which is a chain.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a schematic view of a suppressing element for holding pressure down, with a cut;

FIG. 3*a* shows a detail B of FIG. 2;

FIG. 4A is a perspective view of the suppressing element of another embodiment;

FIG. 4B is a top plan view of the suppressing element of FIG. 4A;

DETAILED DESCRIPTION OF THE PREFERRED EMBODIMENTS

Figure 1:
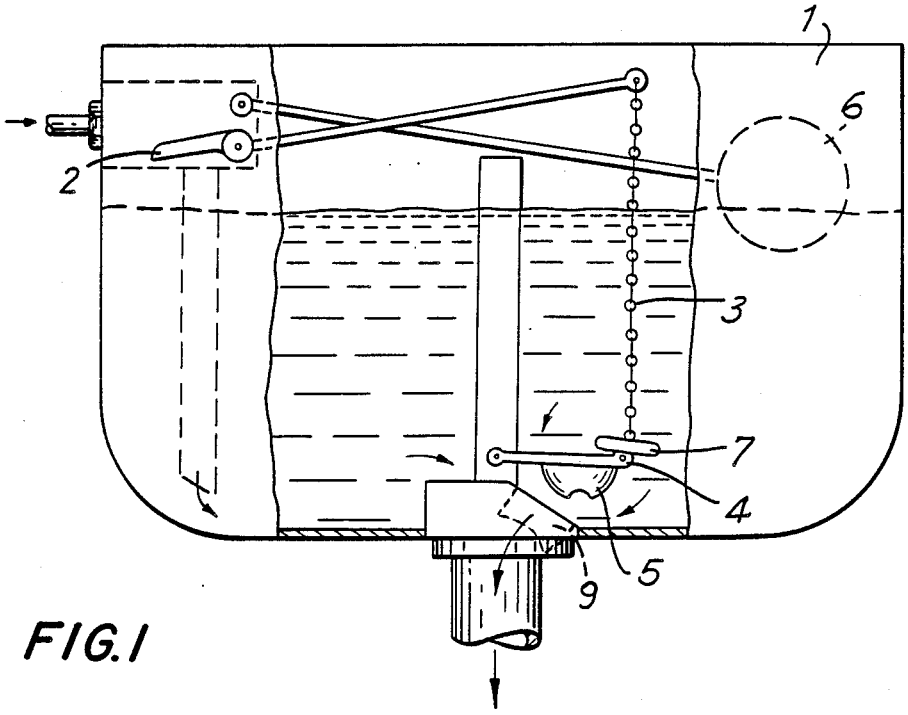
FIG. 1 is a schematic view of a rinsing tank of the invention with an open valve.
Figure 2:
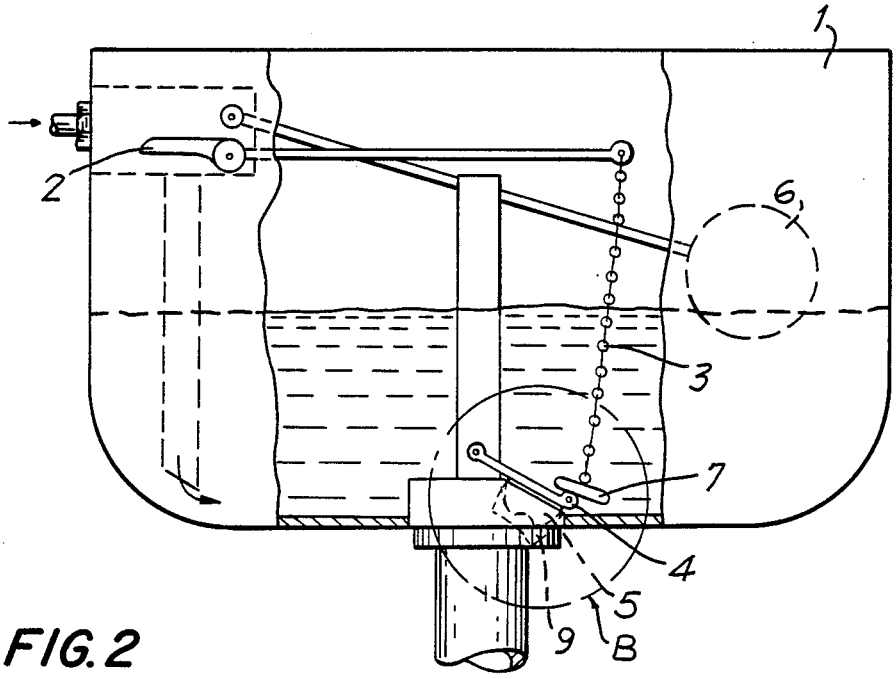
FIG. 2 is a schematic view of the rinsing tank with the closed valve.

Referring now to the drawings in detail, and firstly to FIGS. 1 and 2, it will be seen that a rinsing basin or tank according to the invention includes a housing 1 which is filled with water. A rinsing knob 2 which is connected via a pulling means, for example a chain 3, with a locking or closing element 5 having an elastic outer surface, is hinged through a lever 4 on the housing 1. The buoyancy of the closing element 5, and also its volume and weight are adjusted to each other in such a way that the hydrostatic pressure tightly presses the closing element against a discharge or outlet opening 9 and which, however, after the lifting of the weight or ceasing of the hydrostatic pressure cannot close the discharge opening 9 because the closing element 5 is no longer in the buoyant state. Thereby all the water in the tank flows out. A float valve 6 serves the purpose of refilling the tank.

An additional weight 7 which is also shown in greater detail in FIG. 3 hangs on the chain 3 and prevents the buoyant condition of the closing element 5. This rationing of the rinsing water which can be adjusted to a respective purpose results in a substantial reduction of water consumption.

A friction disc 10 shown in FIG. 3 has a diameter which is greater than the diameter of the weight 7 and serves the purpose of increasing the time of opening the outlet or discharge 9. By enlarging or reducing the size of this disc the dosing of the water discharged can be attained such that only a very short pressing of the knob 2 should take place to enable the basin to discharge a predetermined water portion. This discharge water portion should be smaller than the entire filling amount of the basin.

The aforementioned additional weight 7 which hangs on the pulling means, e.g. chain 3 to act on the closing element 9 via lever 4 is herein identified as a suppressing element which in the embodiment of FIG. 3 is formed as a ring having a cut or slit 8. Ring 7 should be made of plastic, for example lead or should be soft elastic, for example of plastic provided with heavy filling so that this material would be easily bent into ring 7 and light to hang on the chain 3.

In the embodiment illustrated in FIGS. 4A and 4B, the suppressing element is designated at 7/3 and is formed as a helical ring which is open and can be rolled in the pulling means 3 to hang on the latter.

Figure 5A:
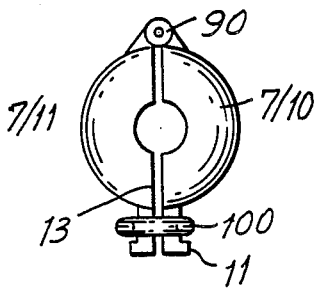
FIGS. 5*a*–5*e* illustrate a retainer of yet another embodiment.
Figure 5B:
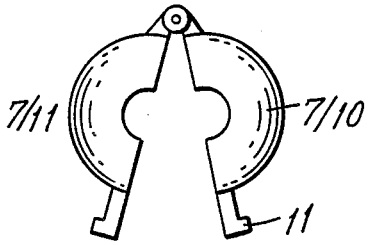
Figure 5C:
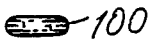
Figure 5D:
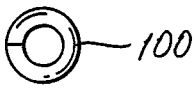
Figure 5E:
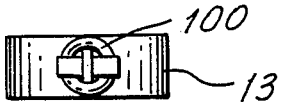
Figure 6A:
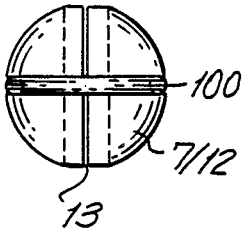
FIGS. 6*a*–6*d* show still another embodiment of the suppressing element.
Figure 6B:
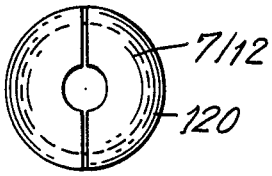
Figure 6C:
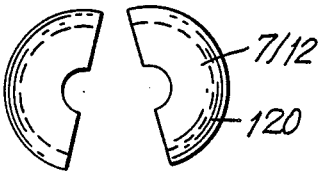
Figure 6D:
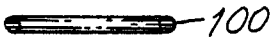
Figure 6E:
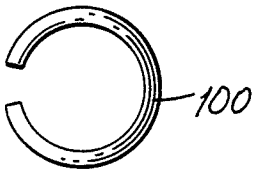

In the embodiment shown in FIGS. 5*a*–5*e*, the suppressing element 13 is formed of two half-rings 7/10 and 7/11 which are pivotable relative to each other and connected to each other at a hinge 90. These two half-rings 7/10 and 7/11 are connected to each other to form a ring, at projections 11 extending outwardly from each half-ring by means of a retainer 100 which is also a ring of a spring type. FIGS. 5*c* and 5*d* show ring 100 in the side view and the top plan view, respectively.

In the embodiment of FIGS. 6*a* to 6*e*, the suppressing element 13 is formed of two half-rings 7/12 and 7/14 formed each with a groove 120. A connecting spring ring 100 is inserted into grooves 120 of two adjacent half-rings 7/12 and 7/14 to hold them together.

It will be understood that each of the elements described above, or two or more together, may also find a useful application in other types of WC water tanks differing from the types described above.

While the invention has been illustrated and described as embodied in a WC water tank, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for the reduction of the amount of rinsing water in a WC-water tank including a housing to be filled with water and having an outlet opening, a rinsing knob supported on the housing, a closing element operatively connected to the knob for closing and opening the outlet opening, the closing element being formed as a buoyant element, and pulling means connecting the closing element to the knob, said reduction device comprising a ring-shaped suppressing element provided on the closing element and made of elastic material with high specific weight, said suppressing element encircling the pulling means and exerting on the closing element a force which is greater than a force required to maintain the closing element in a buoyant state, said ring-shaped suppressing element including at least one ring; and a friction disc mounted on said pulling element between said closing element and said ring-shaped suppressing element for joint movement therewith for delaying closing of the outlet opening, said friction disc having a diameter which is larger than that of said ring-shaped suppressing element so that only a very short pressing of the knob enables the tank to discharge a predetermined portion of water which is smaller than an entire filling amount of water in the tank.

2. The device as defined in claim 1, wherein said suppressing element is formed of two half-rings pivotally connected to each other.

3. The device as defined in claim 2, wherein said one ring may be formed with an interrupting gap.

4. The device as defined in claim 2, wherein said suppressing element is made of plastic.

5. The device as defined in claim 2, wherein said friction disc is a ring with an interrupting gap.

6. The device as defined in claim 2, wherein said two half-rings have each a projection outwardly extending from a respective half ring, said suppressing element further including a spring retaining element connecting two projections of the two half-rings to each other.

7. The device as defined in claim 1, wherein said one ring is helical in shape.

8. The device as defined in claim 1, wherein said suppressing element includes two half-rings each formed with a circumferential groove, and a spring ring inserted into the grooves of said two half-rings to connect said half-rings to each other.

* * * * *